US005791749A

United States Patent [19]

O'Neill et al.

[11] Patent Number: 5,791,749

[45] Date of Patent: *Aug. 11, 1998

[54] THEFT-RESISTANT DISPLAY CASE

[75] Inventors: Brian K. O'Neill; Dennis R. Pound, both of Cape Coral, Fla.

[73] Assignee: Tampco Fixture Group, Inc., Fort Myers, Fla.

[ * ] Notice: The term of this patent shall not extend beyond the expiration date of Pat. No. 5,733,021.

[21] Appl. No.: 811,517

[22] Filed: Mar. 4, 1997

Related U.S. Application Data

[63] Continuation-in-part of Ser. No. 675,793, Jul. 5, 1996, Pat. No. 5,733,021.

[51] Int. Cl.[6] ..... A47F 3/00

[52] U.S. Cl. ..... 312/117; 312/297; 312/138.1; 312/310

[58] Field of Search ..... 312/114, 21, 204, 312/117, 138.1, 291, 310, 297, 139.1, 319.5, 319.8, 312, 313, 323, 196; 160/201, 230, 232, 235

[56] References Cited

U.S. PATENT DOCUMENTS

| | | | |
|---|---|---|---|
| 2,284,531 | 5/1942 | Miller et al. | 312/310 |
| 2,655,419 | 10/1953 | Achs | 312/138.1 X |
| 2,688,527 | 9/1954 | Wright | 312/297 X |
| 2,739,730 | 3/1956 | Jonas | 160/235 X |
| 3,896,742 | 7/1975 | Ferraro | 312/297 X |
| 4,755,011 | 7/1988 | Seroka et al. | 312/297 X |
| 4,929,862 | 5/1990 | Hamilton et al. | 312/138.1 |
| 5,129,611 | 7/1992 | Grover et al. | 312/312 X |

*Primary Examiner*—Peter M. Cuomo
*Assistant Examiner*—Janet M. Wilkens
*Attorney, Agent, or Firm*—William E. Noonan

[57] ABSTRACT

A theft-resistant display case includes a housing having a lower storage section and an upper display section mounted above the storage section. The storage section has an obscuring exterior wall and the display section has an exterior wall that is at least partly transparent. A platform is movably mounted within the housing for supporting items to be displayed. The platform is selectively raised into a first position in the housing wherein items supported on the platform are displayed in the upper section of the housing. The platform is selectively lowered into a second position in the housing wherein items supported on the platform are stored in the lower section of the housing. An obscuring closure, which includes a roll-up grill, is selectively interposed between the upper and lower sections when the platform is in the second position such that the platform and items supported thereon are enclosed within the lower section of the housing and hidden from view.

10 Claims, 3 Drawing Sheets

THEFT-RESISTANT DISPLAY CASE

RELATED APPLICATION

This application is a continuation-in-part of U.S. application Ser. No. 08/675,793, which was filed on Jul. 5, 1996 and is now U.S. Pat. No. 5,733,021.

FIELD OF THE INVENTION

This invention relates to a theft-resistant display case and, more particularly, to a case for displaying jewelry and other valuable merchandise during normal business hours and for automatically moving such merchandise out of view and storing it in a locked condition during after-business hours.

BACKGROUND OF THE INVENTION

Display cases are widely employed by both department stores and smaller retailers for displaying a wide variety of merchandise. Glass and mirrored display cases are commonly used to feature fine jewelry, coins and other valuable items. Unfortunately, most conventional cases are extremely susceptible to theft and burglary. Accordingly, security precautions require that valuable merchandise be removed from the display case nightly, following the close of business and placed in a safe, vault or other secure, locked location. The following morning, the merchandise must be moved back into the case.

Constantly filling and emptying the display case with merchandise is both tedious and time consuming. Additionally, constantly moving the merchandise between the display case and safe or other locked location increases the risk that items will be lost or misplaced. It is impractical however, to leave valuable merchandise in most standard display cases overnight. Although such cases can be secured by a variety of locks, they usually comprise a glass construction that is easily broken and penetrated by both experienced and inexperienced thieves. Alarms are also readily bypassed by skilled burglars.

At present, there exists a significant need for a relatively simple and inexpensive display case that serves both to display jewelry and other valuable merchandise in an attractive manner and to securely guard such merchandise in a hidden and locked condition during after-business hours.

Our previously filed patent application Ser. No. 08/675,793 discloses a theft-resistant display case wherein merchandise is mounted on a platform that is selectively raised and lowered within the display case by a lift mechanism. When the platform is lowered within the display case, a door or closure is introduced between upper and lower portions of the display case to conceal the merchandise. This door or closure is removed from between the upper and lower sections of the case when it is time to raise the platform and display the merchandise. The details described in our previously filed application are fully incorporated herein by reference. Although the versions described in that application represent a significant improvement over the prior art, we have determined that still further improvements are desirable. For example, operating the closure described in that embodiment typically requires store personnel to lift and lower a panel that may be bulky and/or heavy. This can cause strain and possible injury to the person's back. Accordingly, we are disclosing herein a closure that is much easier to raise and lower.

SUMMARY OF INVENTION

It is therefore an object of this invention to provide an improved, theft-resistant display case that safely and securely holds valuable merchandise in a locked and hidden condition during after-business hours.

It is a further object of this invention to provide a theft-resistant display case having a relatively simple and easy to operate construction that is affordable to retailers of all sizes.

It is a further object of this invention to provide a theft-resistant display case that securely holds valuable merchandise within the case, both during and after normal business hours so that the case does not have to be emptied and refilled on a daily basis.

It is a further object of this invention to provide a theft-resistant display case that eliminates the time, tedium and labor normally required to empty and restock display cases on a daily basis.

It is a further object of this invention to provide a theft-resistant display case that eliminates the need for a separate safe, vault or other locked location to store valuable merchandise during after-business hours.

It is a further object of this invention to provide a theft-resistant display case that is difficult for a thief to penetrate.

It is a further object of this invention to provide a theft-resistant display case that is relatively easy for store personnel to use and operate.

It is a further object of this invention to provide a theft-resistant display case that permits valuable merchandise to be quickly and conveniently removed from view and securely stored during after business hours and at other times when required.

It is a further object of this invention to provide a theft-resistant display case that has safety features which prevent accidental damage to the stored merchandise.

It is a further object of this invention to provide a theft-resistant display case that utilizes a closure that is very easy for store personnel to operate.

It is a further object of this invention to provide a theft-resistant display case that employs a closure which may be conveniently raised and lowered, as required, without causing back strain or other injury to store personnel.

It is a further object of this invention to provide a theft-resistant display case that employs a roll-up or grill for concealing the merchandise at night.

This invention features a theft-resistant display case. The case includes a housing having an upper display section and a lower storage section. The lower storage section has an obscuring exterior wall and the upper display section is mounted above the lower section and has an exterior wall that is at least partly transparent. A platform is movably mounted within the housing for supporting items to be displayed. There are means for selectively raising the platform into a first position in the housing wherein items supported on the platform are displayed in the upper section of the housing and lowering the platform into a second position in the housing wherein items supported on the platform are stored in the lower section of the housing. An obscuring closure is selectively interposed between the upper and lower sections when the platform is in the second position. As a result, the platform and the items supported thereon are enclosed within the lower section of the housing and hidden from view.

In a preferred embodiment, the case includes means for removably supporting the closure in the interposed condition in the housing between the upper and lower sections. The housing may include a slot through which the closure is selectively interposed and at least partly removed from between the upper and lower sections of the housing.

Means may be provided for locking the closure in the interposed condition. In particular, a lock may be mounted in the housing above the slot and the outer section of the closure may carry a latch that is selectively engaged by the lock to hold the closure in the interposed condition. The closure may comprise a roll-up grill that is movably supported between the upper and lower sections within a track. In one version, the track may comprise a pair of generally L-shaped slots formed on respective sides of the housing. The roll-up grill is supported within horizontal portions of the track to interpose the grill between the upper and lower sections of the housing. Alternatively, the grill may be moved into vertical portions of the track to expose the lower section of the housing and the platform.

In another version, the roll-up grill may be mounted within a grill enclosure that is carried by a lower portion of the housing. A distal end of the grill is movably received in a track, which comprises a pair of generally horizontal slots formed between the upper and lower sections of the housing. The grill may be unrolled to interpose the grill between the upper and lower sections of the housing. Alternatively, the grill is rolled into the grill housing to expose the lower section of the housing. Preferably, the roll-up grill comprises a standard roll-up grill structure of the type used in hurricane shutters. A standard crank mechanism may be used to selectively roll and unroll the grill.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
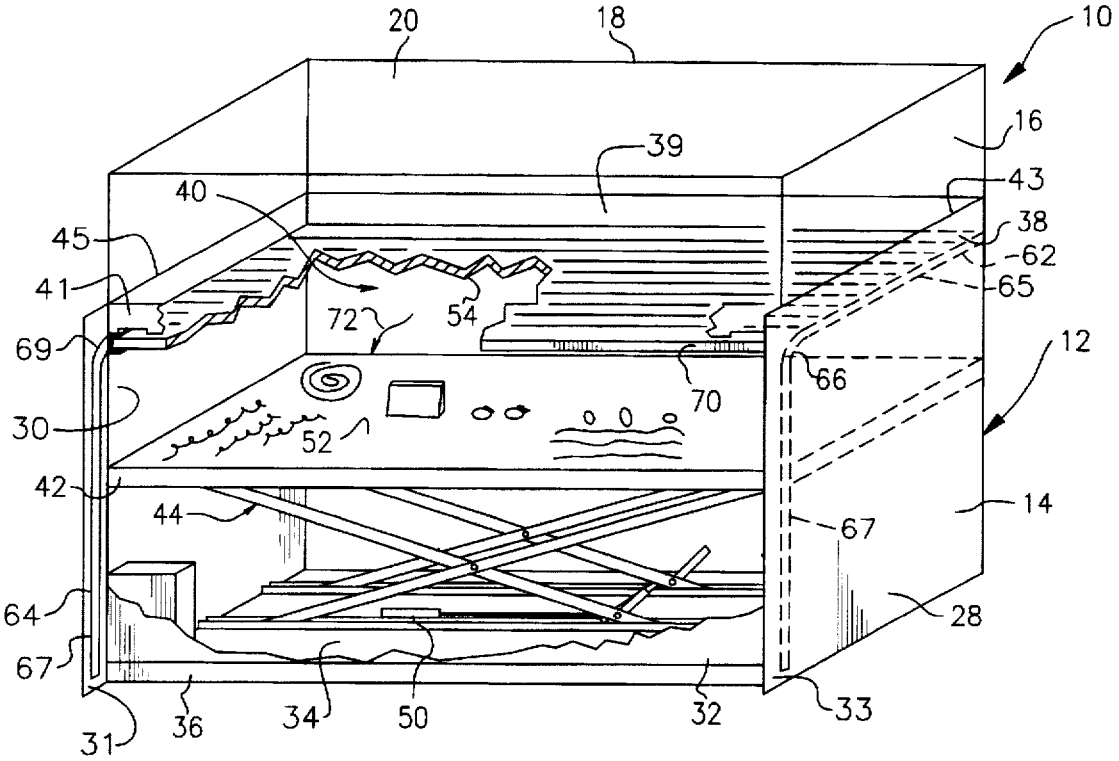
FIG. 1 is a perspective, simplified and partly cut away view of a preferred theft-resistant display case according to this invention, which case employs a roll-up grill type of closure.
Figure 2:
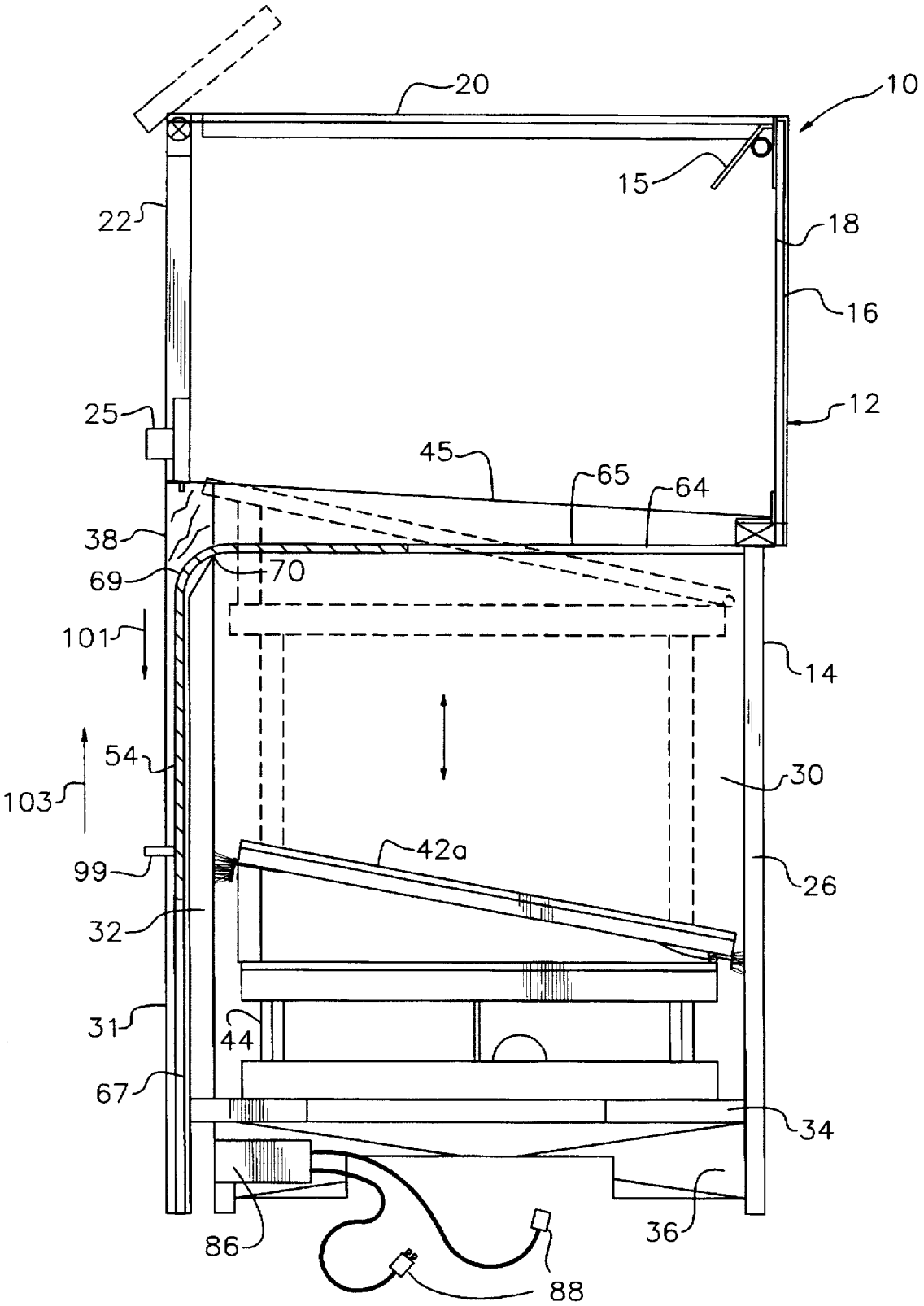
FIG. 2 is an elevational, side view of a display case which includes a roll-up grill closure of the type shown in FIG. 1.

There is shown in FIGS. 1 and 2 a display case 10 comprising a housing 12 having a lower section 14 and an upper section 16. It should be understood that much of the structure of display case 10 is previously described in co-pending patent application Ser. No. 08/675,793, the specification of which is incorporated herein by reference. Accordingly, for simplicity and clarity, much of the previous description is omitted herein. The present specification is concerned primarily with describing improved versions of the closure 54, which is selectively interposed and removed from between the upper and lower sections 14 and 16.

Figure 4:
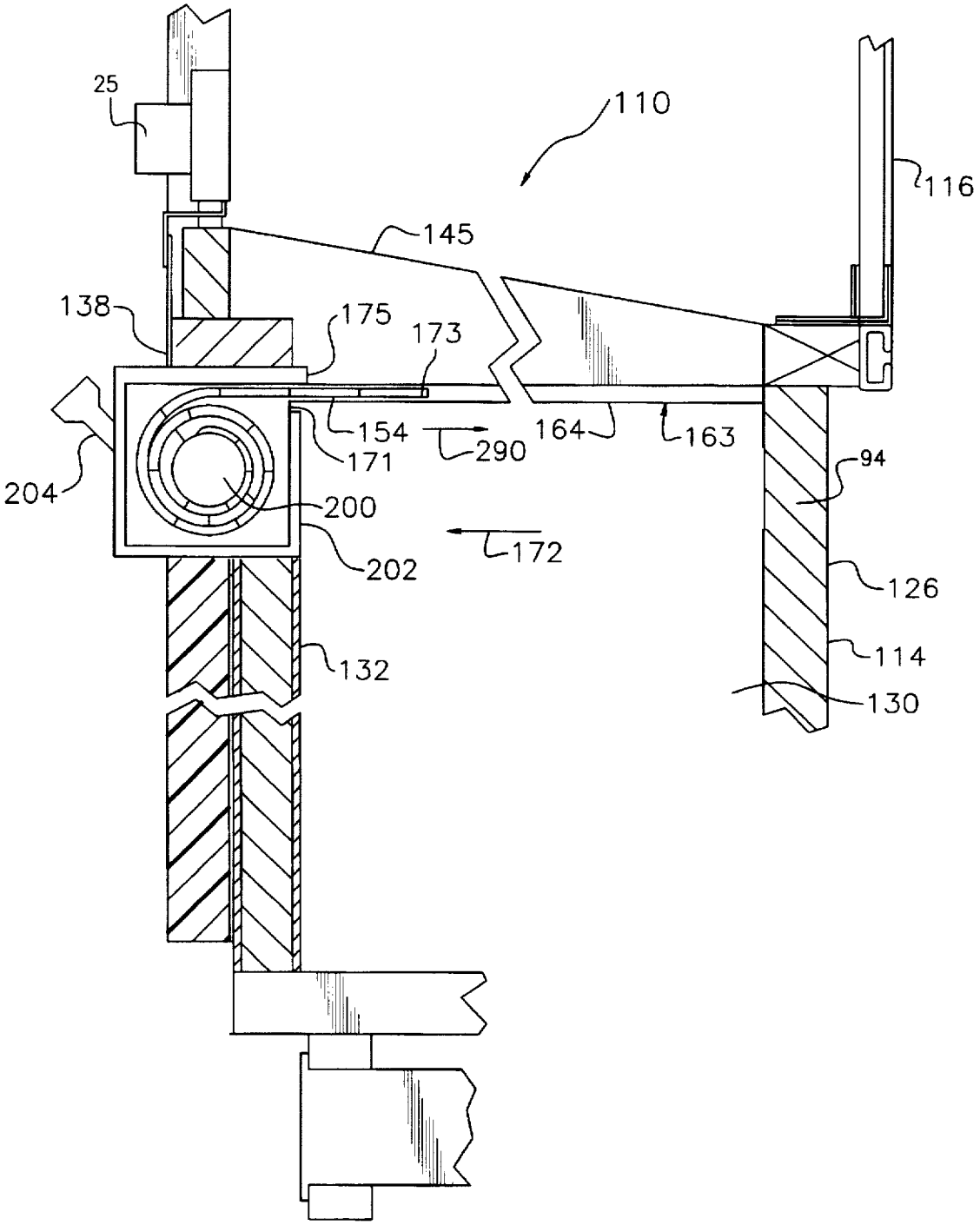
FIG. 4 is an elevational, cross sectional view of a display case that employs an alternative type of roll-up grill closure.

Upper section 16 typically features a conventional display case construction and includes one or more transparent glass walls. At the very least, the front wall 18 and the upper wall 20 are transparent. The remaining walls of upper section 16 may be either fully transparent or interiorly lined with mirrors or an opaque material, as desired. As shown in FIG. 2, a lamp 15 may be mounted within the upper housing section. The walls of upper section 16 may be joined together by an appropriate metal frame or other standard display case structure. Access into display section 16 may be provided through one or more hingedly attached display doors 22, FIG. 2, formed in the rear of the case. Each door has a lock 25 mortised to the inside surface thereof. This lock, shown specifically in FIGS. 2 and 4, is selectively operated to lock a respective one of the doors in a closed condition. In alternative embodiments, one or more sliding doors may be provided in the rear wall of upper section 16. The remaining details of the upper section should be well known to those skilled in the art of display cases and do not comprise a part of this invention.

Lower housing section 14 is defined by four interconnected exterior walls 26, 28, 30 and 32 that form the front, sides and rear of the housing, respectively. The exterior walls surround a floor 34 that is disposed above a base 36. A pair of vertical components 31 and 33 are attached unitarily or otherwise to side walls 30 and 28, respectively. Each of components 31 and 33 protrudes rearwardly from rear wall 32. These vertical components are employed to carry respective vertical portions of the track in which the closure of this invention is movably mounted. This construction is described more fully below.

The upper edge of lower section 14 carries a peripheral rail or lip portion 38 that extends about the display case and defines the lower boundary of upper section 16. In particular, rail portion 38 includes a forward rail element 39, a rearward rail element 41 and tapered side rail elements 43 and 45. The upper section 16 is mounted to lower section 14 in a conventional manner. The exterior walls that form lower section 14 are composed of a suitable wood or wood laminate material. Alternatively, fiberglass and various synthetic structural components can be used. In various embodiments, the walls may be attached to an interior metal framework. It is important that the lower section walls be obscuring. This means that they are opaque or otherwise nontransparent so that merchandise can be effectively stored within lower section 14 and obscured from view after business hours. Although the display case is a generally rectangular cross sectional shape, it should be understood that various alternative shapes may be employed.

Housing sections 14 and 16 define an interior compartment 40. A merchandise display platform 42, FIG. 1, is mounted within compartment 40 on a standard scissor jack lift 44. The lift is itself supported on floor 34 of lower housing section 14. Lift 44 is operated in a conventional manner by motor 50 to selectively raise and lower platform 42 within housing 12.

As shown by the somewhat altered platform **42*a* in FIG. 2, the platform is preferably sloped downwardly from front to back so that merchandise 52 supported by the platform is properly displayed through the transparent walls of upper section 16 when the platform is in a raised position within housing 12. The platform may be mounted to lift 44** by bolts, fasteners or other appropriate means of attachment that should be understood to those skilled in the art. It should be noted that various types of lift and elevator mechanisms may be employed to selectively raise and lower the platform. The invention is not limited to the scissor jack lift depicted in the drawings.

In FIGS. 1 and 2, lift 44 and platforms 42 and **42*a* are illustrated in a lowered condition wherein the respective platforms and displayed merchandise 52 are disposed completely within lower housing section 14. The upper and lower sections of housing 12 are separated by an obscuring closure 54 that is selectively interposed between lower housing section 14 and upper housing section 16. Closure 54 comprises a standard roll-up grill of the type used for roll top desks and hurricane shutters. Grill 54 includes a plurality of elongate elements or slats that are flexibly attached in a side by side arrangement. The grill is substantially opaque or otherwise non-transparent. Grill 54 is slidably supported within housing 12 by a pair of elongate channels or tracks 62 and 64 that are mounted to or formed in respective interior sides 28 and 30 of lower housing section 14. Each track has a generally L-shaped configuration. In particular, each track includes a generally horizontal portion 65 and a generally vertical portion 67. A curved junction portion 69, having a radius of about 2 inches, interconnects track portions 65 and 67. The longitudinal ends of each slat in grill 54 are received by the opposing tracks 62 and 64, respectively. The entire grill 54 is slidably movable along the tracks, as shown by arrow 101 and 103 in FIG. 2, such that the grill may be selectively interposed and removed from between lower housing section 14 and upper section 16. Grill 54 is sufficiently large such that the lower housing section 14 is covered when the grill is interposed between the upper and lower sections in the manner shown in FIGS. 1 and 3**.

Figure 3:
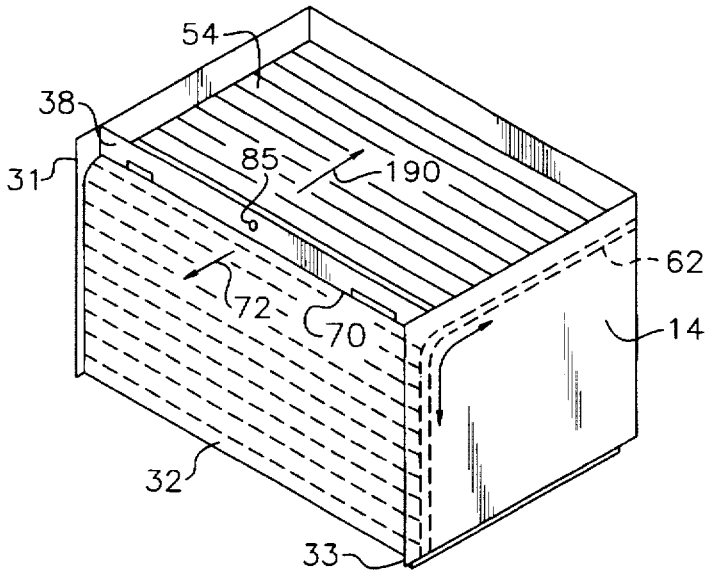
FIG. 3 is a perspective side view of the lower section of the display case, with the roll-up grill closure of FIG. 2 shown in its interposed and removed positions.

In FIG. 1, grill 54 is received by respective portions 65 of tracks 62 and 64. As a result, the grill is interposed between the upper and lower sections of the housing. The interior of lower section 14, platform 42 and merchandise 52 are hidden from view. Rearward wall 32 includes an elongate slot 70, which is also shown in FIG. 3. Slot 70 is formed immediately below rail 38. Roll-up grill 54 is selectively introduced into and removed from housing 12 through slot 70. The slot is arranged such that tracks 62 and 64 extend through slot 70. Accordingly, grill 54 slides selectively back and forth along tracks 62 and 64 by passing through slot 70. More particular, grill 54 slides between horizontal portions 65 and vertical portions 67 of tracks 62 and 64. When grill 54 is fully removed from between the lower and upper housing sections, the grill is held in place by vertical portions 67 of tracks 62 and 64.

As illustrated in FIG. 3, a closure lock 85 is formed centrally in the rearward side of rail 38 just above slot 70. Grill 54 may include a corresponding latch that is engaged by lock 85 when grill 54 is in the horizontal, closed condition, shown in FIGS. 1 and 3. This latch structure, which is not described herein, is analogous to that shown and described in co-pending patent application Ser. No. 08/675.793. As a result, grill 54 is secured by lock 85 in a locked horizontal condition, such that a potential thief cannot gain access to the merchandise contained in lower housing section 14.

Grill 54 is operated in the manner illustrated in FIGS. 1–3. As best shown in FIG. 3, a handle 99 is carried proximate the lower end of grill 54. The grill is selectively raised and lowered within tracks 62 and 64 by grasping handle 99 and simply raising or lowering the grill in a manner similar to a garage door. Typically, at night or at other times when the display case is not in use, grill 54 is positioned in the closed condition illustrated in FIGS. 1 and 3 such that the lower section of the housing and the merchandise contained therein are concealed from view. During business hours, jewelry or other merchandise is normally displayed within case 10. To prepare the case for display, grill 54 is pulled into its opened condition. Specifically, lock 85 is opened so that the closure is released. Pull handle 99 is grasped and the grill is pulled rearwardly as indicated by arrow 72, FIG. 3, and downwardly in the manner shown by arrow 101 in FIG. 2. The grill slides smoothly along tracks 62 and 64. The tracks 62 and 64 guide the grill from horizontal track sections 65, outwardly through slot 70 and downwardly into the respective track sections 67 located in vertical segments 31 and 33. Grill 54 travels through junction portion 69 and is lowered until it engages the lower ends of vertical track portions 67. As a result, the grill is positioned outside of the wall 32 of lower housing section 14 in the manner best illustrated in phantom in FIG. 3. The merchant or salesperson then energizes the case (this may also be done initially) in the manner indicated in co-pending patent application Ser. No. 08/675.793. Lift 44 is operated to raise platform 42, **42*a* in the manner illustrated in FIG. 2. A limit switch may be provided to prevent the lift from raising when closure 54** is in the closed, interposed condition.

At night, the display case is closed quickly, automatically and securely by simply reversing this operation. Initially, the lift and platform are lowered within section 14 of the housing and returned to the position shown in FIG. 1. The sales person or other store personnel then grasps handle 99 and raises the grill in the manner indicated by arrow 103 in FIG. 2. The grill travels along tracks 62 and 64 and is introduced horizontally into the housing through slot 70. The grill slides forwardly in the manner indicated by arrow 190 in FIG. 3 until it completely covers lower housing section 14. The lower section of the housing and the merchandise contained therein are thereby hidden from view. The retailer then uses an appropriate key to operate lock 85 so that closure 54 is secured in place. Grill 54 is opaque so that interior space 40 is fully concealed.

The components of roll-up grill 54 may be composed of various durable, high strength materials. These may include various woods, wood laminates, metals or synthetics. The material that is used in most standard hurricane shutters is particularly preferred. This material is fairly lightweight so that the closure is relatively easy to manipulate. At the same time, it is extremely rugged and able to withstand great impact forces. As a result, it is very difficult for a thief to break through the closure. Metal lined exterior walls may also be employed to help prevent a would-be thief from breaking through the lower storage section of the housing and removing the contents secured therein.

There is shown in FIG. 4 an alternative manner of mounting a roll up grill within a display case 110. It should be understood that case 110 employs much of the structure of the previously described embodiment, as well as the structure in co-pending patent application Ser. No. 08/675.793 (now U.S. Pat. No. 5,732,021). This version also specifically employs a grill 154 that is mounted in a rolled fashion on a cylinder 200. The cylinder is rotatably mounted within a grill housing 202. The housing is secured to the upper end of wall 132 of lower housing section 114. An upper housing section 116 is mounted above lower housing section 114 in the manner previously described. Rail 138 again comprises a pair of tapered side portions, 145, one of which is shown. The rail is mounted immediately above grill enclosure 202. A lock 25 is used to secure a display window in a locked condition. Again, a display platform and a lift, not shown, are operably mounted within lower section 114 in the manner previously described.

The grill enclosure 202 and roll-up grill 154 comprise a standard hurricane shutter-type construction. A standard drive mechanism 204 is operably interengaged with the roll-up grill 54 in a manner not shown, but which should be well understood to those skilled in the art. Mechanism 204 is engaged by an appropriate hand crank and turned in a first direction to unroll grill 154 from cylinder 200. By turning crank 204 in the opposite direction, grill 154 is rolled onto the cylinder.

A slotted track assembly 163 is formed in the opposing side walls of lower housing section 114, immediately below rail 138. A first, elongate slot 164 slidably receives side of grill 154. A similar slot, not shown, formed in the opposite side wall of lower housing section 114, similarly receives the opposite side of grill 154. In this version, each slot or track comprises a horizontal slotted segment disposed between the upper and lower sections of the housing. The track assembly 163 is aligned with an opening 171 in grill enclosure 202. A distal end 173 of roll-up grill 154 extends through slot 171 and is slidably received in track assembly 163.

In operation, a crank, not shown, is inserted in mechanism 204 and turned in a first direction to unroll grill 154 from cylinder 202. As the mechanism 204 is turned, grill 154 is driven in the direction of arrow 290. Mechanism 204 is turned until distal end 173 of grill 154 engages the forward end of track assembly 163 located adjacent to forward housing wall 126. A standard hurricane shutter lock or latch is operated in a known manner to secure the unrolled grill 154 in place. To open grill 154, the lock is disengaged and mechanism 204 is rotated by the crank in an opposite direction. This causes grill 154 to be drawn in the direction of arrow 172 into enclosure 202 through slot 171. The grill 154 is rolled onto cylinder 202 and lower section 114 of display case 110 is exposed. The lift may be raised and merchandise displayed in case 110.

At the beginning of each business day, the grill is unlocked and pulled out of the housing. The lift and stored merchandise are then raised for display. Each evening, the process is reversed. In this manner, merchandise is safely and securely stored within the display cases during after business hours. The case does not have to be emptied and refilled on a daily basis. The need for a separate safe or vault is also eliminated.

In still other versions of this invention, the roll-up grill may be opened by lowering it into the lower housing section. This may be done manually or automatically using an appropriate motor or other mechanism.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A theft-resistant display case comprising:

a housing that includes a lower storage section having an obscuring exterior wall and an upper display section mounted above said lower section and having an exterior wall that is at least partly transparent;

a platform movably mounted within said housing for supporting items to be displayed;

means for selectively raising said platform into a first position in said housing, wherein items supported on said platform are displayed in said upper section of said housing, and lowering said platform into a second position in said housing wherein items supported on said platform are stored in said lower section of said housing; and an obscuring closure that is selectively interposed between said upper and lower sections when said platform is in said second position, whereby said platform and items supported thereon are enclosed within said lower section of said housing and hidden from view.

2. The case of claim 1 further including means supporting said closure in an interposed condition between said upper and lower sections and for permitting said closure to be at least partly removed from between said upper and lower sections so that said lower section is exposed.

3. The case of claim 2 in which said housing includes a slot through which said closure is selectively interposed and at least partly removed from between said upper and lower sections of said housing.

4. The case of claim 2 further including means for locking said closure in said interposed condition.

5. The case of claim 2 in which said closure includes a roll-up grill and said means for supporting include track means for movably mounting said roll-up grill within said housing.

6. The case of claim 5 in which said track means include a pair of generally L-shaped tracks carried by said housing, each track including a horizontal portion formed between said upper and lower sections of said housing and a vertical portion formed within said lower portion of said housing and into which said grill is selectively moved to expose said lower section of said housing.

7. The case of claim 5 in which said means for supporting further include a grill enclosure mounted to said housing, said grill being supported in a rolled-up configuration within said grill enclosure and having a distal end that is received in said track means, said track means including a pair of generally parallel slots formed between said upper and lower sections of said housing.

8. The case of claim 7 further including means for selectively rolling said grill into said grill enclosure to expose said lower section of said housing and unrolling said grill from said grill enclosure to extend said grill between said upper and lower sections of said housing.

9. The case of claim 1 further including means for selectively removing said closure from between said upper and lower sections of said housing and holding said closure beneath said upper section of said housing to expose said platform and items supported thereon.

10. A theft-resistant display case comprising:

a housing that includes a lower storage section having an obscuring exterior wall and an upper display section mounted above said lower section and having an exterior wall that is at least partly transparent;

a platform movably mounted within said housing for supporting items to be displayed;

means for selectively raising said platform into a first position in said housing, wherein items supported on said platform are displayed in said upper section of said housing, and lowering said platform into a second position in said housing wherein items supported on said platform are stored in said lower section of said housing; and an obscuring closure that is selectively interposed between said upper and lower sections when said platform is in said second position, whereby said platform and items supported thereon are enclosed within said lower section of said housing and hidden from view; said closure including a roll-up grill; and means for supporting said grill in an interposed condition between said upper and lower sections and for permitting said grill to be at least partly removed from between said upper and lower sections so that said lower section and said platform are exposed.

* * * * *

UNITED STATES PATENT AND TRADEMARK OFFICE

CERTIFICATE OF CORRECTION

PATENT NO. : 5,791,749

DATED : August 11, 1998

INVENTOR(S) : Brian K. O'Neill, et al.

It is certified that error appears in the above-identified patent and that said Letters Patent is hereby corrected as shown below:

At [56] References Cited, please add the following patents and publications.

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 8 | 2 | 8 | 3 | 4 | 2 | 05/09/89 | Stefan | | | |
| | | 4 | 4 | 3 | 3 | 8 | 8 | 0 | 02/28/84 | Maravelas, Jr. et al | | | |
| | | 5 | 2 | 7 | 3 | 3 | 5 | 2 | 12/28/93 | Saper | | | |
| | | 5 | 4 | 5 | 0 | 8 | 0 | 0 | 09/19/95 | Leonard | | | |
| | | 5 | 2 | 4 | 9 | 8 | 5 | 5 | 10/05/93 | Franklin et al | | | |
| | | 5 | 1 | 6 | 5 | 7 | 6 | 8 | 11/24/92 | Zarrabi et al | | | |
| | | 4 | 8 | 0 | 4 | 8 | 7 | 7 | 02/14/89 | Harwood | | | |
| | | 4 | 6 | 0 | 0 | 2 | 5 | 4 | 07/15/86 | Whalen | | | |
| | | 3 | 4 | 5 | 6 | 9 | 9 | 5 | 07/22/69 | Nyquist | | | |
| | | 2 | 6 | 1 | 4 | 0 | 2 | 0 | 10/14/52 | Collins | | | |
| | | 2 | 4 | 5 | 5 | 1 | 5 | 4 | 11/30/48 | Bailey | | | |
| | | 4 | 6 | 4 | 1 | 8 | 9 | 6 | 02/10/87 | Iimura et al | | | |

Signed and Sealed this

Twenty-third Day of February, 1999

*Attest:*

Q. TODD DICKINSON

*Attesting Officer*

*Acting Commissioner of Patents and Trademarks*